US012571170B2

(12) United States Patent
Fritz et al.

(10) Patent No.: US 12,571,170 B2
(45) Date of Patent: Mar. 10, 2026

(54) DIFFERENTIAL MILLING AND PAVING

(71) Applicant: Wirtgen GmbH, Windhagen (DE)

(72) Inventors: Matthias Fritz, Hennef (DE); René Müller, Vettelschoß (DE); Manuel Rossa, Aachen (DE)

(73) Assignee: Wirtgen GmbH, Windhagen (DE)

( * ) Notice: Subject to any disclaimer, the term of this patent is extended or adjusted under 35 U.S.C. 154(b) by 994 days.

(21) Appl. No.: 17/725,640

(22) Filed: Apr. 21, 2022

(65) Prior Publication Data

US 2023/0340736 A1 Oct. 26, 2023

(51) Int. Cl.

| | |
|---|---|
| ***E01C 23/07*** | (2006.01) |
| ***E01C 19/00*** | (2006.01) |
| ***E01C 19/48*** | (2006.01) |
| ***E01C 23/088*** | (2006.01) |

(52) U.S. Cl.

CPC ..... *E01C 23/07* (2013.01); *E01C 19/006* (2013.01); *E01C 19/4853* (2013.01); *E01C 23/088* (2013.01)

(58) Field of Classification Search

CPC ..... E01C 19/006; E01C 19/4853; E01C 19/2307; E01C 19/088; E01C 23/07; E01C 23/088

USPC ..... 404/84.05–84.8, 118, 91

See application file for complete search history.

(56) References Cited

U.S. PATENT DOCUMENTS

| | | | | |
|---|---|---|---|---|
| 5,327,345 | A | 7/1994 | Nielsen et al. | |
| 5,549,412 | A | 8/1996 | Malone | |
| 5,612,864 | A | 3/1997 | Henderson | |
| 5,721,685 | A * | 2/1998 | Holland | E01C 23/01 701/470 |
| 6,371,566 | B1 | 4/2002 | Haehn | |
| 7,144,191 | B2 | 12/2006 | Kieranen et al. | |
| 7,946,788 | B2 | 5/2011 | Jurasz et al. | |
| 8,388,263 | B2 | 3/2013 | Fritz et al. | |
| 8,794,867 | B2 | 8/2014 | Snoeck et al. | |
| 8,961,065 | B2 | 2/2015 | Snoeck et al. | |

(Continued)

FOREIGN PATENT DOCUMENTS

| | | |
|---|---|---|
| DE | 102012100934 A1 | 8/2013 |
| DE | 102017005015 A1 | 11/2018 |
| EP | 3839146 A1 | 6/2021 |

OTHER PUBLICATIONS

European search report for corresponding patent application No. 23168895.3, dated Jul. 28, 2023, 7 pages (not prior art).

*Primary Examiner* — Raymond W Addie

(74) *Attorney, Agent, or Firm* — Lucian Wayne Beavers; Gary L. Montle; Patterson Intellectual Property Law, PC

(57) ABSTRACT

A system of differential working is provided wherein a controller of a construction machine is provided with a working depth data set and with a design surface data set. A location of the construction machine within a reference system external to the construction machine is determined, for example using a global navigation satellite system. The controller may determine the desired working depth at the current locations of the ends of the working implement from the working depth data set. The controller may determine the desired cross-slope at the current location of the working implement from the design surface data set. The desired working depths and the desired cross-slope may be communicated to a grade control system of the controller.

26 Claims, 8 Drawing Sheets

(56) References Cited

U.S. PATENT DOCUMENTS

| | | | | |
|---|---|---|---|---|
| 8,989,968 | B2 | 3/2015 | Fritz et al. | |
| 9,039,320 | B2 | 5/2015 | Snoeck et al. | |
| 9,096,977 | B2 | 8/2015 | Fritz et al. | |
| 9,719,217 | B2 | 8/2017 | Fritz et al. | |
| 9,896,810 | B2 | 2/2018 | Berning et al. | |
| 11,193,245 | B2 | 12/2021 | Menzenbach et al. | |
| 11,459,712 | B2 | 10/2022 | Fritz | |
| 11,629,463 | B2 | 4/2023 | Menzenbach et al. | |
| 2008/0152428 | A1 | 6/2008 | Berning et al. | |
| 2009/0292412 | A1 | 11/2009 | Han et al. | |
| 2012/0301220 | A1* | 11/2012 | Snoeck | E01C 23/07 701/50 |
| 2015/0115689 | A1 | 4/2015 | Snoeck et al. | |
| 2016/0177517 | A1* | 6/2016 | Engels | E01C 19/002 404/75 |
| 2021/0010210 | A1* | 1/2021 | Ellwein | E01C 19/48 |
| 2021/0189667 | A1 | 6/2021 | Fritz | |

* cited by examiner

DIFFERENTIAL MILLING AND PAVING

BACKGROUND OF THE INVENTION

1. Field of the Invention

The present application relates to a construction machine having a working implement for working a ground surface and to methods of operation of such a construction machine.

2. Description of the Prior Art

The planning and implementation of a construction project to create a design surface from an existing ground surface has traditionally been performed in a series of manually controlled operations. Such a design surface may be a milled surface created in a milling operation or it may be a paved surface created in a paving operation.

In the example of a road milling project, first a survey is done of the area of the ground where the milling is to take place. This may for example be the initial survey done of an area where a road or airport or the like is to be constructed. This initial survey data set may identify a series of points on the ground surface which are identified by x, y and z co-ordinates in the local ground based reference system. Such surveys are commonly done and provided to a planning bureau or design office which may use the initial survey to plan a project. The "z" co-ordinate for each point is the actual elevation of that point in the local ground based reference system. This initial survey data set may also be referred to as an "actual data set".

The planning bureau or design office may plan the construction project and create a project design data set which includes a design surface data set that identifies the desired final elevation of the ground surface, and which identifies the project (e.g. a pavement or other structure) to be constructed on the ground surface. One part of this design work is to create a description of the desired milled surface to be created by the road milling machine. This desired surface may be identified by a design surface data set defining a series of desired milled points in the area which are again identified by x, y and z co-ordinates in the local ground based reference system. The "z" co-ordinate for each point is the desired elevation of that point in the local ground based reference system. The data sets are each typically in the form of a set of triangles, each triangle being defined by the absolute x,y,z information for the three corners defined in an external reference system independent of the milling machine. For the "actual data set" defining the existing ground surface the dimensions of the triangles are typically on the order of a few millimeters up to a few inches. For the "design surface data set" the triangles may be much larger and may be larger than the milling machine so that it is possible the milling machine will be located on a single triangle. The size of the triangles may vary within the same project, depending on the surface roughness. The rougher the surface the smaller the triangles should be in order to create the best representation of the actual surface. Scanning is a common method of surveying such an actual surface.

Prior to beginning the milling operation, a surveyor may return to the area to be milled and may locate a number of points on the original ground surface and survey those points to identify the x, y and z co-ordinates of each point in the local ground based reference system. The surveyor will then calculate, based upon the data defining the desired milled surface and the data defining the actual ground surface, the milling depth which is necessary at each point. The surveyor may physically write the desired milling depth on the ground surface adjacent the marked point, such as with a can of spray paint. The marking is typically a spray painted "X" with a spray painted number next to it indicating the desired milling depth at that location.

The milling machine operator then observes the desired milling depth written on the ground surface and adjusts the milling depth of the milling machine accordingly as the point is reached. The operator of the milling machine controls the desired milling depth at each end of the milling drum by inputting that depth, e.g., 2.0", into a grade control system, such as for example the LevelPro control system developed by Wirtgen GmbH, the assignee of the present invention. Alternatively, the operator can input desired milling depth at one end of the milling drum plus desired cross slope of the milling drum. The grade control system then maintains the selected milling depth using any of several combinations of available input sensors, typically two sensors selected from the left sideplate sensor, right sideplate sensor and gravity based cross slope sensor. Other sensors may also be used.

There have been attempts to automate parts of this process. One such attempt is that seen in Snoeck U.S. Pat. No. 8,961,065 and No. 9039320. In the Snoeck patents the actual elevation of the bottom of each end of the milling drum is determined and is then controlled based on a comparison to the design elevation for the design surface at the locations of each end of the milling drum.

There is a continuing need for improvements in such automated systems, and particularly there is a need for a system which avoids the need for determination of the actual elevation of the milling drum during the milling operation.

SUMMARY OF THE INVENTION

In one embodiment a working depth data set of x, y and working depth data may be created. The working depth data set may be prepared with a separate processor (i.e. not the processor located on the construction machine) and may be prepared prior to the loading of the working depth data set on the controller or associated memory of the construction machine. The working depth data set is not created in real time during the working operation. In the case of a milling operation the working depth is the milling depth. In the case of a paving operation the working depth is the paving depth.

Thus, for example, the planning bureau which creates the design surface data set describing the desired milled or paved surface, may create the working depth data set by a comparison of the initial survey data set with the design surface data describing the design surface. Similarly, the working depth data set may be created on or near the jobsite, by a comparison of the initial survey data set with the design surface data set describing the design surface.

The working depth data set and the design surface data set may then be loaded into a memory associated with a controller on the construction machine. The working depth data set and the design surface data set may be loaded onto the memory associated with the construction machine by wireless connection. Alternatively, the working depth data set and the design surface data set may be loaded onto the memory associated with the construction machine by placing the same on a portable data storage device such as a memory stick or the like. It is not necessary to load the initial survey data set onto the controller of the construction machine.

The construction machine may then perform a ground working operation. The construction machine may be equipped with a GPS or other global navigation satellite system (GNSS) sensor onboard the construction machine that is used to determine the construction machine location as it moves across the ground surface. More particularly the GNSS system may determine the x,y position of each end of the working implement. Based upon those x, y positions the controller may determine desired working depths at each end of the working implement and the desired cross slope as follows and may feed those input values to the grade control system of the construction machine.

Based upon the x, y position of the left end of the working implement the controller may look up the desired working depth at that location in the x, y, working depth data set, and may feed that value to a left side working depth input of the grade control system.

Based upon the x, y position of the right end of the working implement the controller may look up the desired working depth at that location in the x, y, working depth data set, and may feed that value to a right side working depth input of the grade control system.

Based upon the location of the working implement corresponding to the x, y positions of the left and right ends of the working implement the controller may look up the design elevation at selected points in the design surface database along a line in the x, y plane extending through those x, y locations and the controller may determine the desired cross slope for the working implement and may feed that value to a cross slope input of the grade control system.

It is also possible to do similar calculations in advance so long as the future path of the construction machine is known. The desired working depth and the desired cross slope for the expected future positions of the construction machine may be determined from the working depth data set and from the design surface data set by looking at the expected x, y positions of the left and right ends of the working implement along the future path. This can be used to provide a preview for the operator of the upcoming changes in working depth.

On a typical "first pass" working operation in the context of a milling machine the milling machine may begin on the uncut actual surface with both sideplates resting on the uncut surface. First the operator of the milling machine may "zero" the grade control system. This is accomplished by lowering the machine frame and the milling drum until the milling drum first touches the surface to be milled. This setting of the extension of the lifting columns and this position of the sideplate(s) is set as "zero" milling depth.

The grade control system then does the actual milling depth control to the desired milling depth using any one of many possible combinations of sensor inputs.

After such a "first pass" milling operation the milling machine may be operated in a "second pass" mode wherein there is no control to any quantified milling depth. In a typical "second pass" milling operation the right sideplate is allowed to run on the previously cut surface and the milling depth of the right end of the milling drum is set to zero to match the previously cut surface. The grade control system may then use the gravity based cross slope sensor to control the actual cross slope to the desired cross slope.

Numerous objects, features and advantages of the embodiments set forth herein will be readily apparent to those skilled in the art upon reading of the following disclosure when taken in conjunction with the accompanying drawings.

DETAILED DESCRIPTION

The following disclosure describes multiple embodiments of a construction machine having a working implement for working a ground surface. In one embodiment as described with regard to FIGS. 1-12 the construction machine may be a road milling machine wherein the working implement is a milling drum. In a further embodiment described with regard to FIGS. 13-18, the construction machine may be an asphalt paving machine wherein the working implement is a paving screed. The construction machine may also be embodied as a concrete paving machine wherein the working implement is a mold of a slip form paver. The construction machine may further be embodied as a road grader wherein the working implement is a grader blade.

Figure 1:
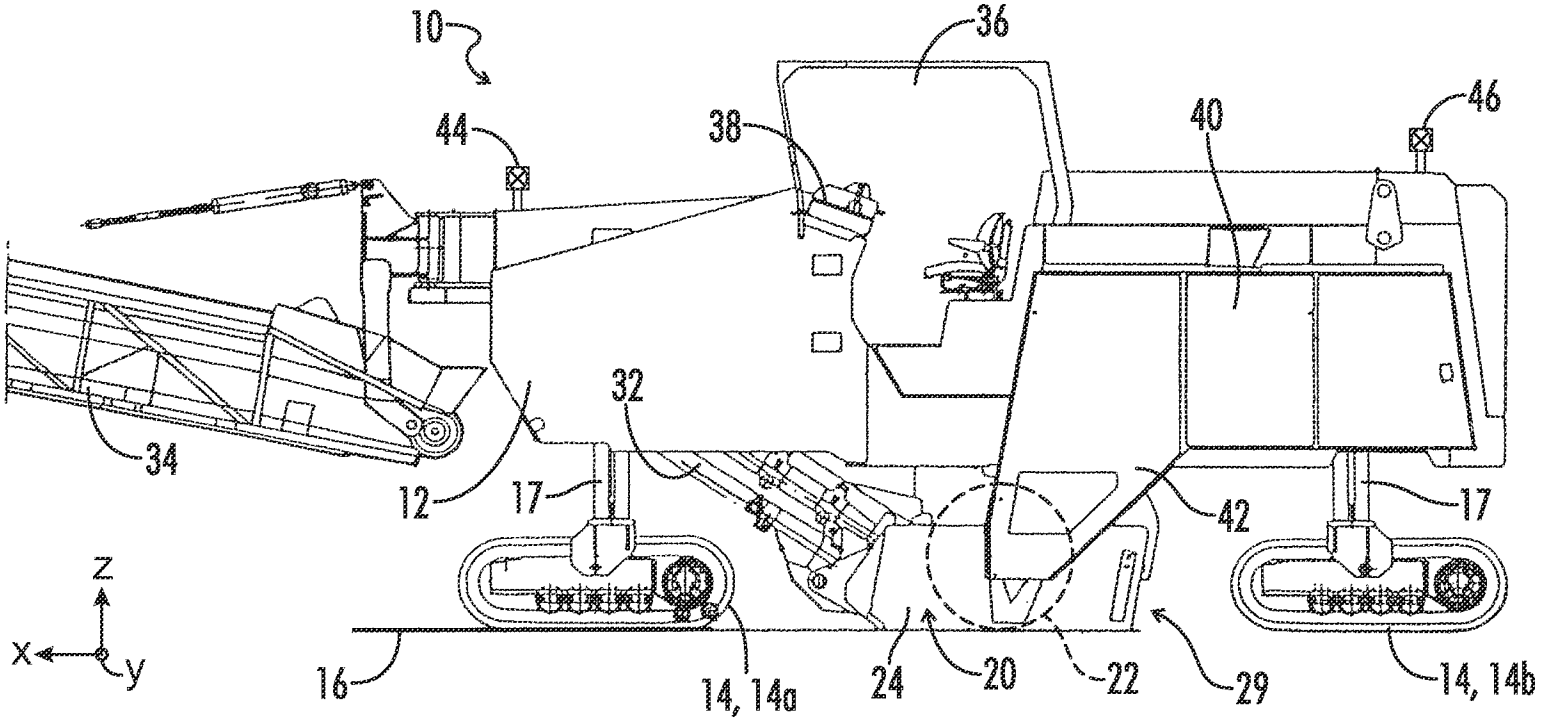
FIG. 1 is a left side elevation view of a construction machine embodied as a road milling machine incorporating the present invention.
Figure 2:
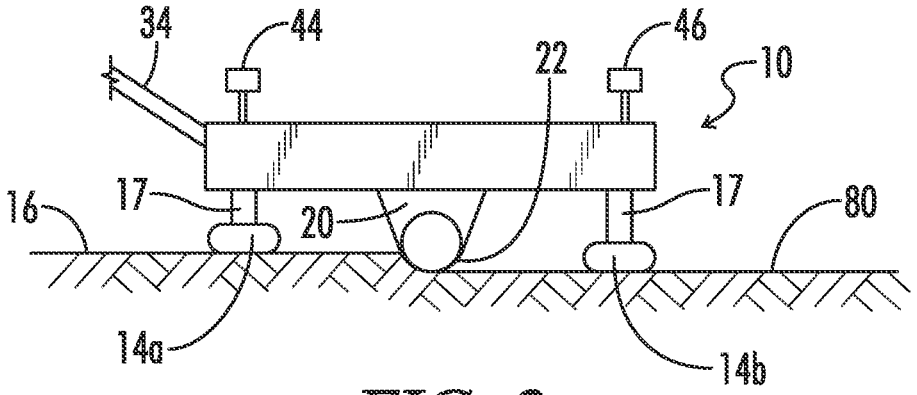
FIG. 2 is a schematic left side elevation view of the road milling machine of FIG. 1 performing a milling operation, wherein the rear tracks of the road milling machine are running in the milled track.

Referring now to the drawings, and particularly to FIG. 1 a construction machine in the form of a road milling machine is shown and generally designated by the number 10. The machine 10 includes a machine frame 12. A plurality of ground engaging units 14, shown in the form of tracks support the machine 10 from a ground surface 16. Wheeled ground engaging units may also be used. The ground engaging units 14 include two front ground engaging units 14*a* and two rear ground engaging units 14*b*. A plurality of lifting columns 17 support the machine frame 12 in a height adjustable manner from the ground engaging units 14.

A milling drum housing 20 is supported from the machine frame 12. A rotatable milling drum 22 is at least partially received by the milling drum housing 20 and is also supported from the machine frame 12. Thus, a height of the machine frame 12 and the milling drum 22 relative to the ground surface 16 are adjustable by adjusting an extension of the lifting columns 17. On its left and right sides, the milling drum housing 20 is closed by left and right adjustable height sideplates 24 and 26 located adjacent left and right ends 28 and 30 of milling drum 22. A height adjustable scraper blade 29 may close a rear of the milling drum housing 20.

The earth working machine 10 shown in FIG. 1 is of the type generally referred to as a large front loading milling machine, which also includes first and second conveyor sections 32 and 34 for conveying milled material away from the milling drum 22. An operator's station 36 may be carried on the machine frame 12 and a control panel 38 may be located at the operator's station 36. A main engine 40, which may be in the form of a diesel internal combustion engine or any other suitable power source is located behind the operator's station 36. A direct belt drive arrangement (not shown) may connect the engine 40 to the milling drum 22 in a known manner. The direct belt drive arrangement may be located in a belt housing portion 42.

Figure 10:
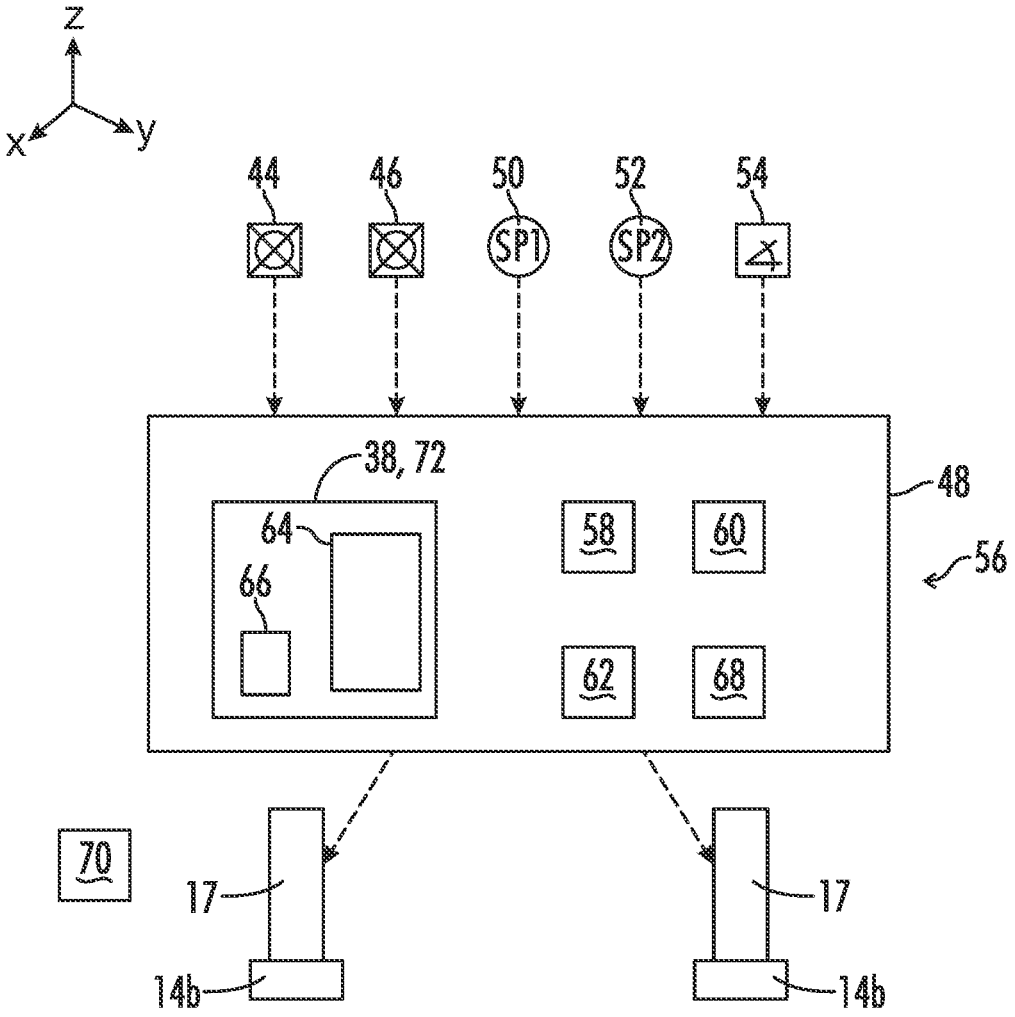
FIG. 10 is a schematic illustration of the controller with associated sensor inputs and control outputs in the embodiment of the milling machine of FIGS. 1-9.

The construction machine 10 may carry at least one position data determination component 44 and 46, supported from the machine frame 12 and operable to determine position data to define a current position of a reference point on the machine in a reference system external to the construction machine. In one embodiment the at least one position data determination component includes at least two position data determination components 44 and 46 in the form of Global Navigation Satellite System sensors, for example GPS sensors. In another embodiment the position data determination components 44 and 46 may be reflectors configured for use with a laser based Robotic Total Station. By including at least two such position data determination components the position of the locations of the two position data determination components allow the corresponding positions of all points on the machine 10 to be determined. The x, y and z components of such a reference system external to the milling machine are schematically represented in FIGS. 1 and 10. The x, y positions may represent positions in a horizontal plane and the z position may represent vertical positions relative to the horizontal plane. In FIG. 1 the x direction happens to be shown as corresponding to the forward direction of the milling machine but that is purely coincidental and is in no way required.

Controller:

Position signals from the sensors 44 and 46 may be received in a controller 48 of the construction machine 10 as schematically shown in FIG. 10. The controller 48 is described here in the context of its usage with the road milling machine 10 to control a milling depth of the milling drum during a milling operation. This can more generally be referred to as controlling a working depth of a working implement during a working operation, and it will be understood that it is also applicable to the embodiment of an asphalt paving machine described below with reference to FIGS. 13-18 in which the controller controls a paving depth, i.e. paving thickness, of a paving screed during a paving operation.

The controller 48 may also receive signals from height sensors 50 and 52 associated with the left and right sideplates 24 and 26, respectively, which signals correspond to actual milling depths of the left and right ends 28 and 30, respectively. The height sensors 50 and 52 may for example be integral to hydraulic smart cylinders which support the sideplates 24 and 26 relative to the machine frame 12. Controller 48 may also receive a signal from a gravity based slope sensor 54 indicative of a cross-slope of the machine frame 12. As is further explained below the controller 48 may send command signals to the left and right lifting columns, for example the left and right rear lifting columns 17 to adjust the actual milling depths of the left and right ends 28 and 30 of the milling drum 22.

As schematically illustrated in FIG. 10, the construction machine 10 includes a control system 56 including the controller 48. The controller 48 may be part of the machine control system of the construction machine 10, or it may be a separate control module. The controller 48 may for example be mounted in the control panel 38 located at the operator's station 36. The controller 48 is configured to receive input signals from the various sensors, such as the sensors 44, 46, 50, 52 and 54 already described. The signals transmitted from the various sensors to the controller 48 are schematically indicated in FIG. 10 by lines connecting the sensors to the controller with an arrowhead indicating the flow of the signal from the sensor to the controller 48.

Similarly, the controller 48 will generate control signals for controlling the operation of the various actuators such as the lifting columns 17 associated with rear ground engaging units 14*b*, which control signals are indicated schematically in FIG. 10 by lines connecting the controller 48 to graphic depictions of the various actuators with the arrow indicating the flow of the command signal from the controller 48 to the respective actuators. It will be understood that for control of a hydraulic cylinder type actuator the controller 48 may send an electrical signal to an electro/mechanical control valve (not shown) which controls flow of hydraulic fluid to and from the hydraulic cylinder.

Controller 48 includes or may be associated with a processor 58, a computer readable medium 60, a data base 62 and an input/output module or control panel 38 having a display 64. An input/output device 66, such as a keyboard, joystick or other user interface, is provided so that the human operator may input instructions to the controller. It is understood that the controller 48 described herein may be a single controller having all of the described functionality, or it may include multiple controllers wherein the described functionality is distributed among the multiple controllers.

Various operations, steps or algorithms as described in connection with the controller 48 can be embodied directly in hardware, in a computer program product 68 such as a software module executed by the processor 58, or in a combination of the two. The computer program product 68 can reside in RAM memory, flash memory, ROM memory, EPROM memory, EEPROM memory, registers, hard disk, a removable disk, or any other form of computer-readable medium 60 known in the art. An exemplary computer-readable medium 60 can be coupled to the processor 58 such that the processor can read information from, and write information to, the memory/storage medium. In the alternative, the medium can be integral to the processor. The processor and the medium can reside in an application specific integrated circuit (ASIC). The ASIC can reside in a user terminal. In the alternative, the processor and the medium can reside as discrete components in a user terminal.

The term "processor" as used herein may refer to at least general-purpose or specific-purpose processing devices and/or logic as may be understood by one of skill in the art, including but not limited to a microprocessor, a microcontroller, a state machine, and the like. A processor can also be implemented as a combination of computing devices, e.g., a combination of a DSP and a microprocessor, a plurality of microprocessors, one or more microprocessors in conjunction with a DSP core, or any other such configuration.

Figure 11:
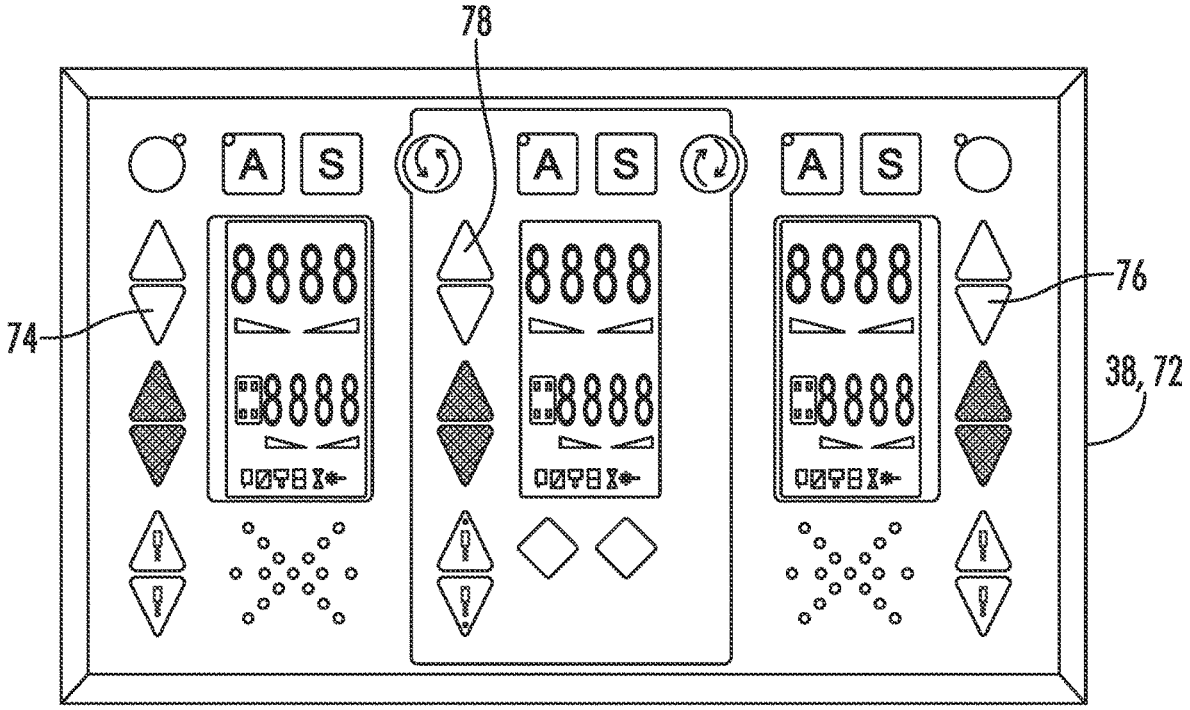
FIG. 11 is a schematic illustration of a control panel of the controller associated with the grade control system of the milling machine.

The control panel 38 may for example include a control panel as schematically shown in FIG. 11 of a grade control system 72 of the milling machine 10. The grade control system 72 may for example be a LevelPro grade control system as developed by Wirtgen GmbH, the assignee of the present application. A further description of such a grade control system 72 is found in U.S. Pat. No. 7,946,788 the details of which are incorporated herein by reference. The operator of the milling machine may control the desired milling depth at each end 28 and/or 30 of the milling drum 22 by inputting that depth, e.g., 2.0", into the grade control system 72. Alternatively, the operator can input desired milling depth at one end of the milling drum plus desired cross slope of the milling drum. FIG. 11 shows a control panel 28 by means of which a human operator may input set values for the milling depths of the ends of the milling drum and/or the cross-slope angle of the milling drum. As is further explained in U.S. Pat. No. 7,946,788 the center input device 78 can be formatted for the input of either the cross-slope or the left side or right side milling depth. The left side input device 74 can be formatted to input either the left side milling depth or the cross-slope. The right side input device 76 can be formatted to input either the right side milling depth or the cross-slope. As further described below the present invention may automatically generate those inputs of desired milling depth and/or cross-slope and input those values into the grade control system 72. The grade control system 72 then maintains the selected milling depth using any of several combinations of available input sensors, typically two sensors selected from the left sideplate sensor 50, right sideplate sensor 52 and gravity based cross slope sensor 54.

Building A Project Model:

When a road milling or other construction project is planned a survey may be done of the area of the ground where the milling is to take place. This may for example be the initial survey done of an area where a road or airport or the like is to be constructed. This initial survey data set may identify a series of points on the ground surface 16 which are identified by x, y and z co-ordinates in the local ground based reference system. Such surveys may be provided to a planning bureau or design office which may use the initial survey to plan a project. The "z" co-ordinate for each point is the actual elevation of that point in the local ground based reference system.

The planning bureau or design office may plan the construction project and create a project design data set which includes a design surface data set that identifies the desired final elevation of the ground surface, and which identifies the project (e.g. a pavement or other structure) to be constructed on the ground surface. One part of this design work is to create a description of the desired milled surface to be created by the road milling machine. This desired surface may be identified by a design surface data set defining a series of desired milled points in the area which are again identified by x, y and z co-ordinates in the local ground based reference system. The "z" co-ordinate for each point is the desired elevation of that point in the local ground based reference system. The databases are each typically in the form of a set of triangles, each triangle being defined by the absolute x,y,z information for the three corners defined in an external reference system independent of the milling machine. For the "actual data set" defining the existing ground surface the dimensions of the triangles are typically on the order of a few millimeters up to a few inches. For the "design surface data set" the triangles may be much larger and may be larger than the milling machine so that it is possible the milling machine will be located on a single triangle.

In one embodiment of the present invention a milling depth data set of x, y and milling depth data may be created. The milling depth data set may be prepared with a separate processor 70 schematically shown in FIG. 10 (i.e. not the processor 48 located on the milling machine 10) and may be prepared prior to the loading of the milling depth data set on the controller 48 of the milling machine 10. The milling depth data set is not created in real time during the milling operation.

Thus, for example, the planning bureau which creates the design surface data set describing the desired milled surface, may create the milling depth data set by a comparison of the initial survey data set with the design surface data set describing the desired milled surface. Similarly, the milling depth data set may be created on or near the jobsite, by a comparison of the initial survey data set with the design surface data set describing the desired milled surface 82. It is also noted that the milling depth data set may be updated during a milling operation. For example, it may be decided to perform a desired milling operation in two cuts rather than one. Thus, if the initial milling depth is 4 cm at a particular x, y location, it might be desired to do that it two passes of about 2 cm each. A first pass may be made at a first milling depth less than 4 cm. The controller may then update the milling depth data set by subtracting the depth of the initial cut from the initial milling depth. Then on a second pass the updated milling depth data set will be used to control the cut to the final total desired milling depth.

Similarly, the planning bureau may create a paving depth data set to describe a layer of paving to be created on the ground surface to create a final paved ground surface. The layer of paving may for example be placed upon a previously milled surface. So in a first instance there may be a design surface data set defining a milled surface to be created, and in a second instance there may be a second design surface data set describing a paved surface to be created on top of the milled surface. The paving depth data set may be in the form of x, y and paving depth data.

It will be appreciated that the local ground based coordinate system in which the initial survey and the design surface data set are created may not be the same coordinate system as the Global Navigation Satellite System in which the sensors 44 and 46 operate, but the correlations of the positions in the local ground based coordinate system relative to positions in the Global Navigation Satellite System are known and the one or the other data sets may be converted as necessary for comparison to signals in the selected reference system of the sensors 44 and 46 being used.

The milling depth data set and the design surface data set may then be loaded into the memory 60 of the controller 48 on the milling machine 10. The milling depth data set and the design surface data set may be loaded onto the memory 60 of the milling machine 10 by wireless connection. Alternatively, the milling depth data set and the design surface data set may be loaded onto the memory 60 of the milling machine 10 by placing the same on a portable data storage device such as a memory stick or the like and then transferring the data from the portable data storage device to the memory 60 of the milling machine 10. This may be described as providing the milling depth data set and the design surface data set to the controller 48. As used herein "providing" a data set to the controller 48 includes in any way making the data set accessible by the controller 48, and it is not necessary that the data set be stored in a memory integral to the controller.

It is not necessary to provide the initial survey data set to the controller 48 of the milling machine 10.

In one embodiment the separate processor 70 may be associated with an online portal created as a service to owner/operators of the milling machine 10. The machine owner/operator and/or a surveyor and/or planning bureau working with the machine owner may upload their survey data set and design surface data set to the online portal. Then the separate processor 70 may create the milling depth data set and format the milling depth data set and the design surface data set for use with the milling machine 10. When the owner/operator of the milling machine 10 is ready to perform the milling operation the milling depth data set and the design surface data set may be wirelessly downloaded from the separate processor 70 of the online portal to the controller 48 of the milling machine 10.

The road milling machine 10 may then perform a ground milling operation as schematically illustrated in FIGS. 2-5. The road milling machine may be equipped with the GPS or other GNSS sensors 44 and 46 onboard the milling machine 10 that are used to determine the milling machine location as it moves across the ground surface 16. More particularly the GNSS system may determine the x,y position of each end 28 and 30 of the milling drum 22 in a reference system external to the milling machine 10, for example in the global positioning coordinates of the GPS system. Those x, y positions of the ends 28 and 30 of milling drum 22 may be correlated to the x, y positions of the milling depth data set and the design surface data set. Based upon the x, y positions of the ends 28 and 30 of milling drum 22 detected by sensors 44 and 46 the controller 48 may determine desired milling depths at each end of the milling drum and the desired cross slope as follows and may feed those input values to the grade control system 72 of the milling machine 10.

Based upon the x, y position of the left end 28 of the milling drum 22 the controller 48 may look up the desired milling depth at that location in the (x, y, milling depth) data set, and may feed that value to the left side milling depth input 74 of the grade control system 72.

Based upon the x, y position of the right end 30 of the milling drum 22 the controller 48 may look up the desired milling depth at that location in the (x, y, milling depth) database, and may feed that value to the right side milling depth input 78 of the grade control system 72.

Based upon the x, y positions of the left and right ends 28 and 30 of the milling drum 22, and optionally at least one point between the left and right ends, the controller 48 may look up the design elevation at each of those points in the design surface database and determine a design cross slope and may feed that value to the cross slope input 76 of the grade control system 72. The desired cross-slope for any given location of the milling drum 22 corresponding to any given x, y positions of the left and right ends 28 and 30 of the milling drum 22 may be determined in several ways as further described below with reference to FIGS. 6-9.

Figure 3:
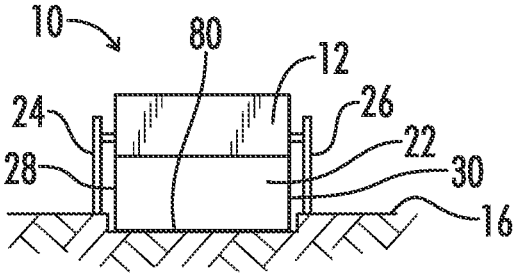
FIG. 3 is a schematic rear elevation view of the machine of FIG. 2 when performing a first pass milling operation.
Figure 4:
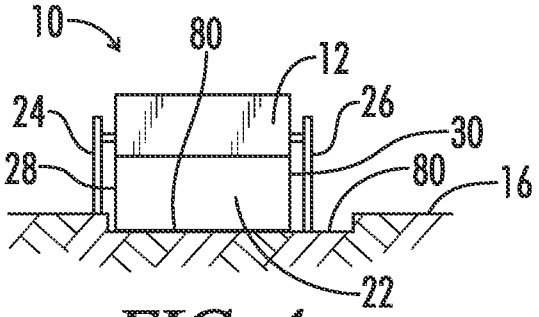
FIG. 4 is a schematic rear elevation view of the machine of FIG. 3 when performing a second pass milling operation adjacent the first pass milling operation.
Figure 5:
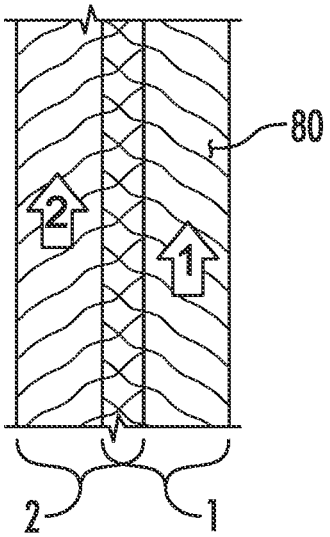
FIG. 5 is a schematic plan view of the ground surface having been milled in both a first pass and a second pass milling operation.

FIG. 5 schematically shows a plan view of both a "first pass" milling operation and an overlapping "second pass" milling operation. The "first pass" is indicated by the shaded area with a "1" in an arrow. The "second pass" is indicated by a shaded area with a "2" in an arrow. FIG. 3 is a schematic rear elevation cross-section view showing the milling machine 10 during the "first pass". FIG. 4 is a schematic rear elevation cross-section view showing the milling machine 10 during the "second pass".

On a typical "first pass" milling operation as represented in FIG. 3 the milling machine 10 may begin on the uncut actual surface 16 with both sideplates 24 and 26 resting on the uncut surface 16. First the operator of the milling machine may "zero" the grade control system 72. This is accomplished by lowering the machine frame 12 and the milling drum 22 until the milling drum 22 first touches the surface 16 to be milled. This setting of the extension of the lifting columns 17 and this position of the sideplates 24 and 26 is set as "zero" milling depth.

The grade control system 72 then does the actual milling depth control to that desired milling depth using any one of many possible combinations of sensor inputs. For example the grade control system 72 may use the two sideplate sensors 50 and 52, or the grade control system 72 may use the cross-slope sensor 54 and one of the sideplate sensors 50 or 52. Other grade sensors such as ultrasonic or laser sensors (not shown) may also be used if available.

After such a "first pass" milling operation as seen in FIG. 3 the milling machine 10 may be operated in a "second pass" mode as seen in FIG. 4 wherein there is no control to any quantified milling depth. In a typical "second pass" milling operation the right sideplate 26 is allowed to run on the previously cut surface 80 of the "first pass" and the milling depth of the right end of the milling drum is set to zero to match the previously cut surface 80. The grade control system 72 may then use the gravity based cross slope sensor 54 to control the actual cross slope to the desired cross slope.

Determination of Desired Cross-Slope:

For any given x, y positions of the two ends 28 and 30 of the milling drum 22 the desired cross-slope angle for the milling drum 22 can be determined by knowing the design surface elevation at those two positions, so long as the design surface is planar between those two positions. There is the possibility, however, that the design surface might have a "crown", a shoulder or other discontinuity between those two positions in which case a cross-slope determined only by comparing those two end positions might be in error. This problem can be solved by including in the cross-slope analysis at least one intermediate point between the two ends 28 and 30. This intermediate point may for example be a mid-point between the two ends. This procedure is schematically illustrated in FIGS. 6-9.

Figure 12:
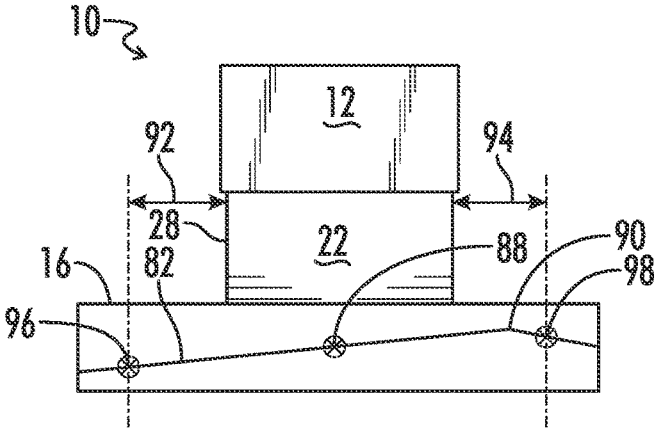
FIG. 12 is a further schematic illustration similar to FIGS. 6-9 but illustrating a technique for identifying a discontinuity in the design surface closely adjacent a planned path of the milling machine.

Furthermore, as schematically illustrated in FIG. 12, it is possible to analyze the design elevations along the line in the x, y plane for points lying laterally outside of the ends of the milling drum in order to identify the presence of non-linearities in the design surface closely adjacent a planned path of the milling machine. This allows the machine operator to perhaps modify the planned path in order to improve milling efficiency. Also, the machine operator may choose to select a different sensor to guide the milling depth control.

Figure 6:
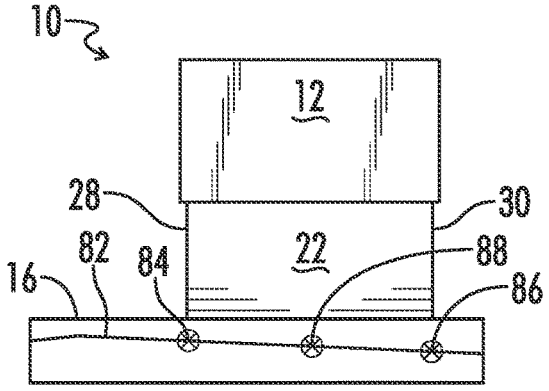
FIG. 6 is a schematic rear elevation view of the milling machine on top of a ground surface to be milled and indicating the design profile of a design surface below the ground surface. Design elevations at the current x, y positions of the left and right ends of the milling drum, and of one intermediate point of the milling drum are indicated by circled "X's". In the situation shown in FIG. 6 the design surface profile underlying the milling drum is straight and the three "X's" are aligned.

FIG. 6 schematically shows a rear elevation view of the milling machine 10 standing on the existing ground surface 16. The underlying design surface is schematically represented by 82. A point on the design surface 82 below the left end 28 of milling drum 22 is indicated by an "X" numbered 84. A point on the design surface 82 below the right end 30 of milling drum 22 is indicated by an "X" numbered 86. A point on the design surface 82 below the mid-point of milling drum 22 is indicated by an "X" numbered 88. The controller 48 is configured to compare the points 84, 86 and 88 and determine whether they lie in a straight line. If they do this indicates that there is no "crown" between the end points and the desired cross-slope is the slope of the line through the three points.

Figure 7:
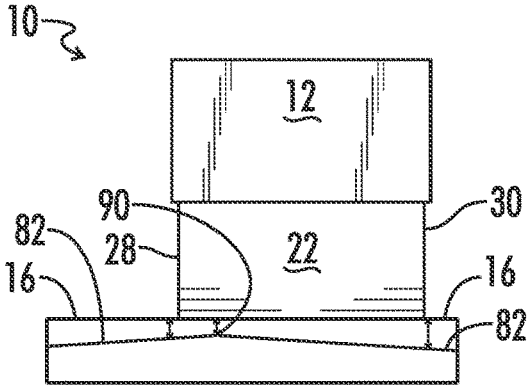
FIG. 7 is a schematic rear elevation view of the milling machine on top of a ground surface to be milled and indicating the design profile of a design surface below the ground surface. In the situation shown in FIG. 7 the design surface profile underlying the milling drum includes a crown.
Figure 8:
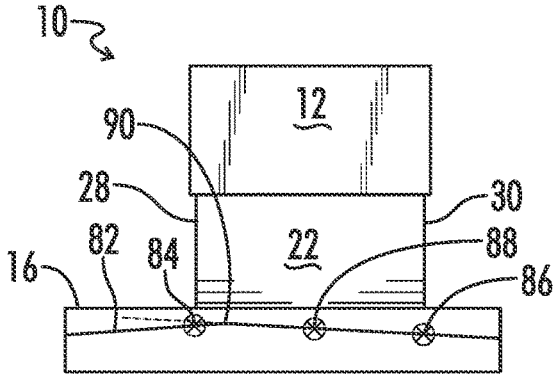
FIG. 8 is a view in the situation of FIG. 7 in which the design elevations at the current x, y positions of the left and right ends of the milling drum, and of one intermediate point of the milling drum are indicated by circled "X's". In the situation shown in FIG. 8 wherein the design surface profile underlying the milling drum includes the crown, the three "X's" are not aligned.
Figure 9:
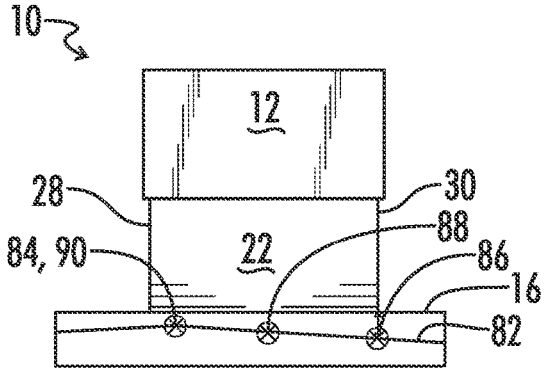
FIG. 9 is a view similar to FIG. 8, showing the location of the crown with a further circled "X" which now aligns with the "X" for the intermediate point and the "X" for the right end of the milling drum.

FIG. 7 schematically shows a rear elevation view of the milling machine standing on the ground surface, but this time standing over a portion of the design surface 82 including a crown 90. FIG. 8 schematically illustrates the comparison by the controller 48 of these three points, which the controller 48 will determine do not lie on a straight line. Once the controller 48 determines that the three points do not lie on a straight line, the next step is to determine the location of the crown 90. This can be done by examining intermediate points inward from one of the outer points 84 and 86 until a design elevation is found that aligns with the other end point and the intermediate point 88. FIG. 9 illustrates this process wherein the left point 84 has been moved inward until it is located at the crown point 90 at which point the three points 84, 86 and 88 are found to be in a straight line. For the example seen in FIG. 9 the desired cross-slope is determined to be the slope of the line through the three points 84, 86 and 88.

It is of course also possible that the controller 48 could be configured to choose the slope to the left side of the crown 90 as the design slope. In situations like that of FIGS. 7-9 the controller may be configured to choose the desired cross-slope as the slope of the longest length underlying the milling drum 22, which in the example of FIG. 9 is the slope on the right side of the crown 90. The controller 48 may also be configured to choose one of the slopes that is contiguous with a previously milled portion, or the controller 48 may be configured such that the slope of the right or left of the crown 90 can be selected by the operator.

FIG. 12 schematically illustrates the further alternative of examining the design elevation of points lying along the line defined by the x, y positions of the two ends of the milling drum but lying laterally outside of the length of the milling drum 22. In the illustrated embodiment the controller may be configured to examine the design milling depth elevations along a line extending between an x, y position laterally spaced a distance 92 to the left of the milling drum 22 and an x, y position laterally spaced a distance 94 to the right of the milling machine 22. The distances 92 and 94 may for example be within a range of from 0 to 3 meters. The design surface elevations 96 and 98 at those x, y positions may be compared with the design surface elevation 88 at the intermediate point on the milling drum 22 in a manner similar to that described above for FIGS. 7-9. In this manner the controller 48 may identify the location of the crown or other discontinuity 90 falling within the lateral distance 94 to the right of the milling drum 22. This information may be displayed to the operator and/or utilized by the controller 48 to modify the planned path of the milling machine 10 or to select a different sensor to guide the milling depth control.

Methods of Operation:

This detailed example of methods of operation is set forth in the context of the use of the road milling machine 10 to control a milling depth of the milling drum during a milling operation. As previously noted this can more generally be referred to as controlling a working depth of a working implement during a working operation, and it will be understood that it is also applicable to the embodiment of an asphalt paving machine in which the controller controls a paving depth, i.e. paving thickness, of a paving screed during a paving operation.

A method of controlling the construction machine 10 including the machine frame 12, the milling drum 22 supported from the machine frame 12, and the controller 48 configured to control the milling depth of the milling drum 22 as the machine moves across the ground surface 16, may comprise:

(a) providing to the controller 48 a milling depth data set including x and y coordinate data in a reference system external to the construction machine, and including desired milling depth data corresponding to the x and y coordinate data;

(b) providing to the controller 48 a design surface data set defining a design surface to be created, the design surface data set including x, y and z coordinate data of the design surface in the reference system external to the construction machine;

(c) performing a milling operation with the milling drum 22 as the machine 10 moves across the ground surface 16;

(d) determining a current x, y position in the reference system external to the construction machine of the first end 28 of the milling drum 22 during the milling operation;

(e) determining a current x, y position in the reference system external to the construction machine 10 of the second end 30 of the milling drum 22 during the milling operation;

(f) determining with the controller 48 from the milling depth data set a desired milling depth for the first end 28 of the milling drum 22 at the current x, y position of the first end 28 of the milling drum;

(g) determining with the controller 48 from the milling depth data set a desired milling depth for the second end 30 of the milling drum 22 at the current x, y position of the second end 30 of the milling drum 22;

(h) determining with the controller 48 from the design surface data set a desired cross-slope for the milling drum 22 at a current location of the milling drum corresponding to the current x, y positions of the first and second ends 28, 30 of the milling drum; and (i) controlling an actual milling depth of the milling drum 22 by performing at least two steps selected from the group consisting of:

(i)(1) controlling an actual milling depth of the first end 28 of the milling drum to correspond to the desired milling depth for the first end 28 at the current x, y position of the first end;

(i)(2) controlling an actual milling depth of the second end 30 of the milling drum to correspond to the desired milling depth for the second end 30 at the current x, y position of the second end; and (i)(3) controlling an actual cross-slope of the milling drum 22 to correspond to the desired cross-slope for the milling drum 22 at the current x, y positions of the first and second ends 28, 30 of the milling drum.

The method may further include determining the current x, y position in the reference system external to the construction machine 10 of at least one intermediate point on the milling drum 22 between the first and second ends of the milling drum during the milling operation. The intermediate point may be above point 88 in FIGS. 6-9. The grade control system 72 may then maintain the selected milling depth using any of several combinations of available input sensors, typically two sensors selected from the left sideplate sensor 50, right sideplate sensor 52 and gravity based cross slope sensor 54.

In the above method the step (h) may further include determining from the design surface data set the desired cross-slope for the milling drum 22 at the current x, y positions of the first and second ends 28, 30 of the milling drum 22 based upon a design elevation of the design surface 82 at the current x, y position of the at least one intermediate point 88 and based on a design elevation of the design surface at the current x, y position of one of the first and second ends as schematically shown in FIG. 9.

Alternatively, in the above method step (h) may include:

determining from the design surface data set a presence of a crown 90 in the design surface 82 between the current x, y positions of the first and second ends; and determining the desired cross-slope for the milling drum at the current x, y positions of the first and second ends of the milling drum as a slope from the crown 90 through the design elevation corresponding to the x, y position of one of the first and second ends 28 or 30 furthest from the crown 90 as schematically shown in FIG. 9.

As a further alternative in the above method, step (h) may include determining from the design surface data set the desired cross-slope for the milling drum 22 at the current location of the milling drum 22 based upon a plurality design elevations of the design surface along a line extending through and beyond the design elevation of the design surface at the current x, y positions of the first and second ends 28 and 30 of the milling drum 22, as schematically shown and described above regarding FIG. 12. The method may further include detecting a discontinuity in the design elevation of the design surface along that line but lying laterally outside of the length of the milling drum 22, for example a shoulder of the design surface.

The methods described above may further include prior to step (a), preparing the milling depth data set by comparing the design surface data set to a survey data set including actual x, y and z coordinates of an existing ground surface 16 to be milled to create the design surface 82.

In the above methods the survey data set is preferably not provided to the controller 48.

In the above methods steps (d) and (e) may be performed using a global navigation satellite system.

In the above methods the milling operation of step (c) may be a first pass milling operation as shown in FIG. 3 in which the ground surface 16 immediately adjacent both of the first and second ends 28 and 30 of the milling drum 22 has not already been milled to the design surface 82.

The above methods may further include performing a second pass milling operation 2 as schematically illustrated in FIGS. 4 and 5. The second pass milling operation 2 may include steps of:

controlling the milling depth of the second end 30 of the milling drum 22 adjacent the milled strip 1 to match an existing elevation of the milled strip 1; and determining from the design surface data set a desired cross-slope for the milling drum 22 at a current location of the milling drum corresponding to the current x, y positions of the first and second ends 28 and 30 of the milling drum 22 during the second pass milling operation 2 using the techniques as described above with reference to FIGS. 6-9; and controlling an actual cross-slope of the milling drum 22 to correspond to the desired cross-slope for the milling drum at the current location of the milling drum 22 during the second pass milling operation 2.

Figure 13:
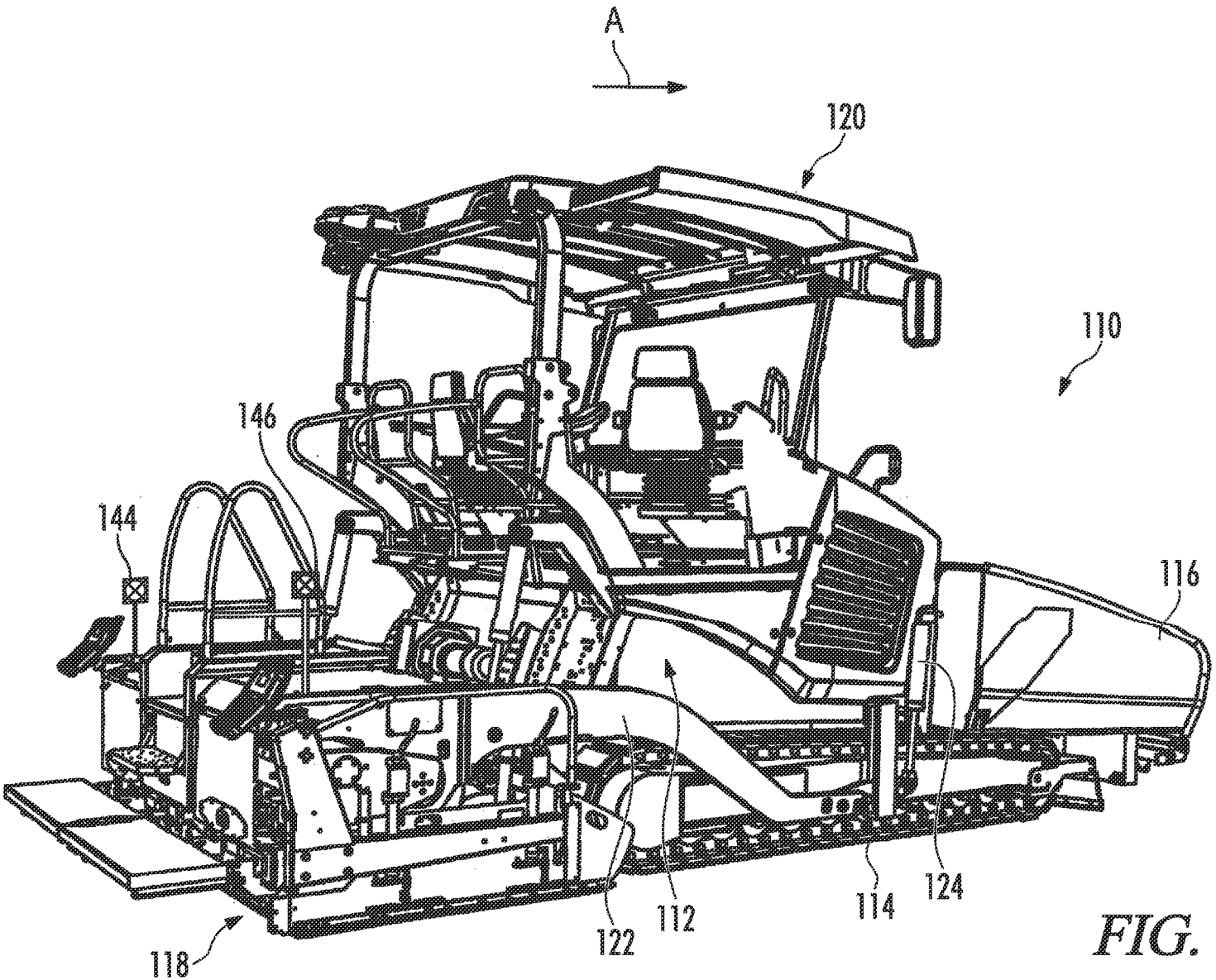
FIG. 13 is a right side perspective view of a construction machine embodied as an asphalt paving machine incorporating the present invention.

Differential Paving with an Asphalt Paving Machine:

Referring now to the drawings, and particularly to FIG. 13 a construction machine in the form of an asphalt paving machine is shown and generally designated by the number 110. The machine 110 includes a machine frame 112. A plurality of ground engaging units 114, shown in the form of tracks support the machine 110 from a ground surface. Wheeled ground engaging units may also be used.

In a front region of the machine frame 112 as seen in the working direction A, a reservoir 116 for holding the material to be laid is arranged. Located at the rear of the road paving machine 110 is a screed 118 for laying the material. The paving screed 118 may be described as a working implement 118 of the paving machine 110. The driver's platform 120 is arranged between the reservoir 116 and the screed 118.

The screed 118 may be configured as a board floating on the material to be laid. For this purpose, the screed 118 is connected to the machine frame 112 by pivot arms 122 so that the screed 118 may move up and down relative to machine frame 112 by pivoting the pivot arms 122 relative to machine frame 112. Pivot actuators 124 may be connected between the machine frame 112 and each of the pivot arms 122 to control this pivotal movement. The desired paving depth or thickness is achieved, in particular, via adjustment of the setting angle of the screed 118, which is determined by the height of a screed traction point. To adjust the screed traction point, the actuators 124 are provided on the sides of the machine frame 112. With the actuators 124, not only the setting angle of the screed 118 but also the incline or cross-slope of the screed 118 can be set transversely to the direction of finishing A.

The paving machine 110 may carry at least one position data determination component 144 and 146, operable to determine position data to define a current position of the left and right ends of the screed 118 in a reference system external to the construction machine. In the embodiment of a paving machine the position data determination components may be located on the ends of the screed 118 or on the pivot arms 122 that move with the screed 118. It is noted that in the context of a paving machine this may be preferred, as contrasted to the milling machine 10 where the position data determination components were located on the machine frame. This is because in the paving machine 110 the working implement moves up and down relative to the machine frame whereas in the milling machine 10 the working implement may be vertically fixed relative to the frame. Thus, placement of the position data determination components on or adjacent the working implement may provide a more direct measure of the position of the working implement in the case of a paving machine. But it is noted that it is also possible to place the position data determination components on the machine frame, even with a construction machine such as an asphalt paving machine wherein the working implement is movable relative to the machine frame, in which case a sensor may be used to detect that relative movement and the controller may then determine the position of the working implement relative to the machine frame.

Figure 14:
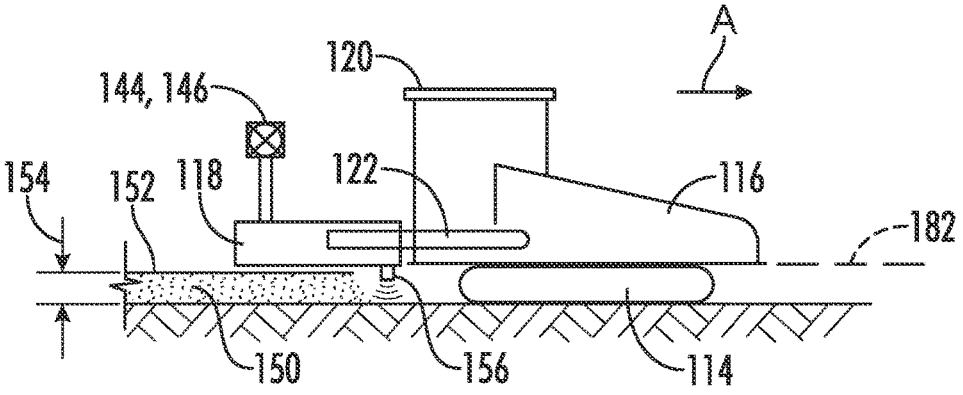
FIG. 14 is a schematic right side elevation view of the paving machine of FIG. 13 performing a paving operation.

FIGS. 14-17 illustrate, in a manner analogous to FIGS. 2-5, how the asphalt paving machine 110 performs its working operations, in this case paving operations. FIG. 14 is a right side elevation schematic view of the paving machine 110 laying down a layer of asphalt paving 150 on a ground surface 16 to form a final paved surface 152. The paved surface 152 may be the design surface planned for the project. The ground surface 16 in this instance may be a previously milled surface. The layer of asphalt paving 150 may have a thickness 154 which may be referred to as a paving depth or working depth 154.

The paving depth 154 is determined by the height of the paving screed 118 above the ground surface which may be detected for example with ultrasonic sensors such as 156 mounted on the screed 118 or on a structure attached to the screed such as the pivot arms 122. As schematically shown in FIG. 15, the screed 118 may also carry a gravity based cross-slope sensor 158 which detects the actual cross-slope from end to end of the paving screed 118.

Actual paving depth signals and actual cross-slope signals from sensors 156 and 158 may be received by a controller such as controller 48 located on the paving machine 110. The controller 48 may then generate control signals sent to the actuators 124 to raise or lower the pivot arms 122 and the ends of the screed 118 as needed to control the paving depth 154 in accordance with the paving depth data set and the design surface data set as described above. In FIGS. 14-17 the design surface for the final paved surface as defined by the design surface data set is represented by the dashed line 182.

Figure 15:
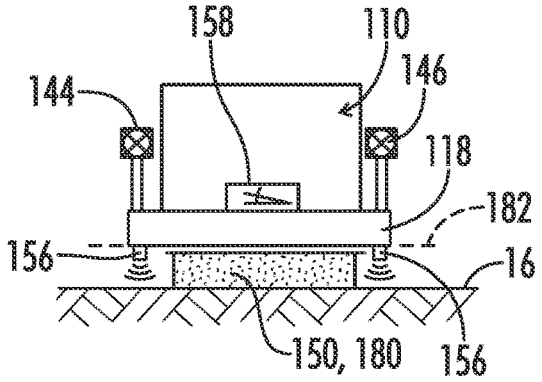
FIG. 15 is a schematic rear elevation view of the machine of FIG. 14 when performing a first pass paving operation.
Figure 16:
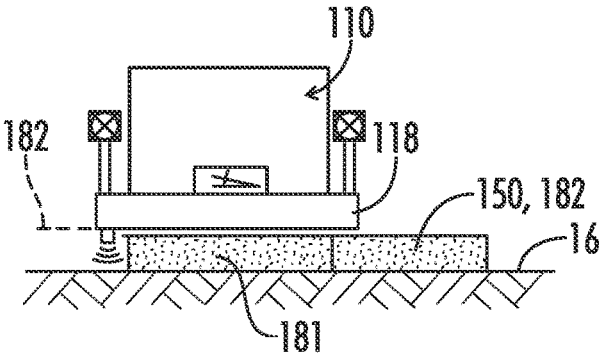
FIG. 16 is a schematic rear elevation view of the machine of FIG. 14 when performing a second pass paving operation adjacent the first pass paving operation.
Figure 17:
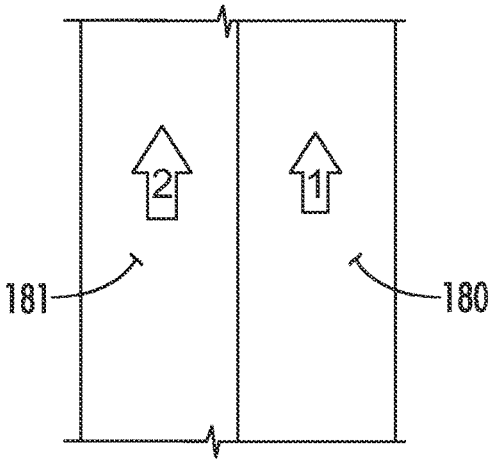
FIG. 17 is a schematic plan view of the ground surface having been paved in both a first pass and a second pass paving operation.

FIG. 15 schematically shows a rear elevation view of the paving machine 110 creating a first worked strip 180, in this case a first paved strip 180. FIG. 16 schematically shows a rear elevation view of the paving machine 110 creating a second worked strip 181 adjacent the first worked strip 180. In this case the right end depth sensor 156 is used to match the right side paving depth of the second worked strip 181 to the paving depth of the adjacent first worked strip 180. The cross-slope sensor 158 is then used to control the cross-slope of the second paved strip 181 to be equal to the desired cross-slope at those x, y locations of the screed 118 as determined from the design surface data set.

Figure 18:
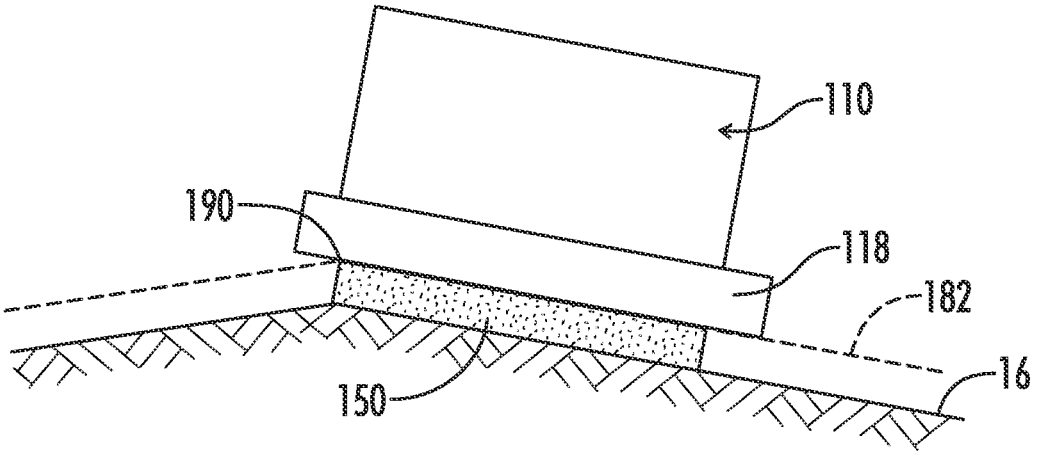
FIG. 18 is a schematic rear elevation view of the paving machine on top of a ground surface to be paved and indicating the design profile of a design paved surface to be created above the ground surface where the design surface includes a crown.

FIG. 18 illustrates an example where the design surface 182 of the asphalt paving 150 includes a discontinuity such as crown 190. The controller 48 may detect the presence of this discontinuity 190 in the same manner as discussed above for the milling machine, by examining the design elevation of the design surface along a line extending through the ends of the screed 118.

Thus, it is seen that the apparatus and methods of the embodiments disclosed herein readily achieve the ends and advantages mentioned as well as those inherent therein. While certain preferred embodiments have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A method of controlling a construction machine including a machine frame, a working implement supported from the machine frame, and a controller configured to control a working depth of the working implement as the machine moves across a ground surface, the method comprising:

(a) providing to the controller a working depth data set including x and y coordinate data in a reference system external to the construction machine, and including desired working depth data corresponding to the x and y coordinate data;

(b) providing to the controller a design surface data set defining a design surface to be created, the design surface data set including x, y and z coordinate data of the design surface in the reference system external to the construction machine;

(c) performing a working operation with the working implement as the construction machine moves across the ground surface;

(d) determining a current x, y position in the reference system external to the construction machine of a first end of the working implement during the working operation;

(e) determining a current x, y position in the reference system external to the construction machine of a second end of the working implement during the working operation;

(f) determining with the controller from the working depth data set a desired working depth for the first end of the working implement at the current x, y position of the first end of the working implement;

(g) determining with the controller from the working depth data set a desired working depth for the second end of the working implement at the current x, y position of the second end of the working implement;

(h) determining with the controller from the design surface data set a desired cross-slope for the working implement at a current location of the working implement corresponding to the current x, y positions of the first and second ends; and (i) controlling an actual working depth of the working implement by performing at least two steps selected from the group consisting of:

(i)(1) controlling an actual working depth of the first end of the working implement to correspond to the desired working depth for the first end of the working implement at the current x, y position of the first end of the working implement;

(i)(2) controlling an actual working depth of the second end of the working implement to correspond to the desired working depth for the second end of the working implement at the current x, y position of the second end of the working implement; and (i)(3) controlling an actual cross-slope of the working implement to correspond to the desired cross-slope for the working implement at the current location of the working implement.

2. The method of claim 1, wherein:

step (i) includes step (i)(3) and only one of steps (i)(1) and (i)(2).

3. The method of claim 1, wherein:

step (i) includes both steps (i)(1) and (i)(2).

4. The method of claim 1, further comprising:

determining a current x, y position in the reference system external to the construction machine of at least one intermediate point on the working implement between the first and second ends of the working implement during the working operation.

5. The method of claim 4, wherein:

step (h) includes determining from the design surface data set the desired cross-slope for the working implement at the current location of the working implement based upon a design elevation of the design surface at the current x, y position of the at least one intermediate point and based on a design elevation of the design surface at the current x, y position of one of the first and second ends.

6. The method of claim 4, wherein step (h) further comprises:

determining from the design surface data set a presence of a discontinuity in the design surface between the current x, y positions of the first and second ends; and determining the desired cross-slope for the working implement at the current location of the working implement as a slope from the discontinuity through the design elevation corresponding to the x, y position of one of the first and second ends furthest from the discontinuity.

7. The method of claim 1, wherein:

step (h) includes determining from the design surface data set the desired cross-slope for the working implement at the current location of the working implement based upon a plurality design elevations of the design surface along a line extending through and beyond the design elevation of the design surface at the current x, y positions of the first and second ends of the working implement.

8. The method of claim 7, wherein:

step (h) includes detecting a discontinuity in the design elevation of the design surface along the line.

9. The method of claim 1, further comprising:

prior to step (a), preparing the working depth data set by comparing the design surface data set to a survey data set including actual x, y and z coordinates of an existing ground surface to be worked to create the design surface.

10. The method of claim 9, wherein:

the survey data set is not provided to the controller.

11. The method of claim 1, wherein:

steps (d) and (e) are performed at least in part using a global navigation satellite system.

12. The method of claim 1, wherein:

the working operation of step (c) is a first pass working operation in which the ground surface immediately adjacent both the first and second ends of the working implement has not already been worked to create the design surface.

13. The method of claim 12, further comprising:

performing a second pass working operation adjacent a worked strip created by the first pass working operation, the second pass working operation including:

controlling the working depth of one of the first and second ends of the working implement adjacent the worked strip to match an existing elevation of the worked strip; and determining from the design surface data set a desired cross-slope for the working implement at a current location of the working implement corresponding to the current x, y positions of the first and second ends of the working implement during the second pass working operation; and controlling an actual cross-slope of the working implement to correspond to the desired cross-slope for the working implement at the current location of the working implement during the second pass working operation.

14. The method of claim 1, wherein:

the working implement is a milling drum; and in step (a) the working depth data set is a milling depth data set and the working depth data is milling depth data describing a desired milling depth by which the ground surface is to be milled to create the design surface.

15. The method of claim 1, wherein:

the working implement is a paver; and in step (a) the working depth data set is a paving depth data set and the working depth data is paving depth data describing a desired paving depth to be paved on the ground surface to create the design surface.

16. A construction machine, comprising:

a machine frame;

a working implement supported from the machine frame for working a ground surface as the machine moves across the ground surface during a working operation;

at least one position data determination component operable to determine position data to define a current position of a reference point on the machine in a reference system external to the construction machine;

a controller associated with a memory, the memory having stored therein a working depth data set and a design surface data set, the controller being operable to receive the position data from the at least one position data determination component;

wherein the working depth data set includes x and y coordinate data in the reference system external to the construction machine, and desired working depth data corresponding to the x and y coordinate data;

wherein the design surface data set defines a design surface to be created, the design surface data set including x, y and z coordinate data of the design surface in the reference system external to the construction machine; and wherein the controller is configured such that during the working operation the controller is configured to:

(a) determine a current x, y position in the reference system external to the construction machine of a first end of the working implement during the working operation;

(b) determine a current x, y position in the reference system external to the construction machine of a second end of the working implement during the working operation;

(c) determine from the working depth data set a desired working depth for the first end of the working implement at the current x, y position of the first end of the working implement;

(d) determine from the working depth data set a desired working depth for the second end of the working implement at the current x, y position of the second end of the working implement;

(e) determine from the design surface data set a desired cross-slope for the working implement at a current location of the working implement corresponding to the current x, y positions of the first and second ends of the working implement; and (f) control an actual working depth of the working implement by performing at least two steps selected from the group consisting of:

(f)(1) controlling an actual working depth of the first end of the working implement to correspond to the desired working milling depth for the first end of the working implement at the current x, y position of the first end of the working implement;

(f)(2) controlling an actual working depth of the second end of the working implement to correspond to the desired working depth for the second end of the working implement at the current x, y position of the second end of the working implement; and (f)(3) controlling an actual cross-slope of the working implement to correspond to the desired cross-slope for the working implement at the current location of the working implement.

17. The construction machine of claim 16, wherein:

the controller is further configured to determine a current x, y position in the reference system external to the construction machine of at least one intermediate point on the working implement between the first and second ends of the working implement during the working operation.

18. The construction machine of claim 17, wherein:

the controller is further configured such that the determination of the desired cross-slope includes determining from the design surface data set the desired cross-slope for the working implement at the current location of the working implement as a line passing through a design elevation of the design surface at the current x, y position of the at least one intermediate point and passing through a design elevation of the design surface at the current x, y position of one of the first and second ends.

19. The construction machine of claim 16, wherein:

the controller is further configured such that the determination of the desired cross-slope includes:

determining from the design surface data set a presence of a discontinuity in the design surface between the current x, y positions of the first and second ends of the working implement; and determining the desired cross-slope for the working implement at the current location of the working implement as a slope from the discontinuity through the design elevation corresponding to the x, y position of one of the first and second ends furthest from the discontinuity.

20. The construction machine of claim 16, wherein:

the memory associated with the controller does not have stored therein a survey data set including actual x, y and z coordinates of an existing ground surface to be worked to create the design surface.

21. The construction machine of claim 16, wherein:

the at least one position data determination component includes at least one global navigation satellite system sensor.

22. The construction machine of claim 16, wherein:

the construction machine is a milling machine;

the working implement is a milling drum; and the working depth data set is a milling depth data set and the working depth data is milling depth data describing a desired milling depth by which the ground surface is to be milled to create the design surface.

23. The construction machine of claim 22, further comprising:

a milling drum housing mounted on the machine frame and receiving the milling drum, the milling drum housing including first and second movable sideplates closing the milling drum housing adjacent the first and second ends of the milling drum, respectively; and first and second sideplate height sensors associated with the first and second sideplates, respectively, the height sensors being configured to send side plate height signals to the controller as indicators of the actual milling depth of the milling drum at the first and second ends, respectively.

24. The construction machine of claim 23, further comprising:

a plurality of ground engaging units configured to support the machine frame from the ground surface; and a plurality of lifting columns, each lifting column extending between the machine frame and one of the ground engaging units, such that the milling depth of the milling drum is adjustable by adjusting an extension of the lifting columns.

25. The construction machine of claim 16, wherein:

the construction machine is a paving machine;

the working implement is a paving screed; and the working depth data set is a paving depth data set and the working depth data is paving depth data describing a desired paving depth to be paved on the ground surface to create the design surface.

26. The construction machine of claim 25, wherein:

the at least one position data determination component includes first and second position data determination components associated with the first and second ends of the paving screed, respectively.

* * * * *